US008180239B2

(12) United States Patent
Furukawa et al.

(10) Patent No.: US 8,180,239 B2
(45) Date of Patent: May 15, 2012

(54) IMAGE FORMING APPARATUS

(75) Inventors: Toshio Furukawa, Nagoya (JP); Hideaki Deguchi, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 0 days.

(21) Appl. No.: 12/624,807

(22) Filed: Nov. 24, 2009

(65) Prior Publication Data

US 2010/0129105 A1 May 27, 2010

(30) Foreign Application Priority Data

Nov. 26, 2008 (JP) ..... 2008-300614

(51) Int. Cl.
*G03G 15/16* (2006.01)

(52) U.S. Cl. ..... 399/66

(58) Field of Classification Search ..... 399/44, 399/66, 92
See application file for complete search history.

(56) References Cited

U.S. PATENT DOCUMENTS 5,182,598 A * 1/1993 Hara et al. ..... 399/303
5,903,798 A * 5/1999 Yokogawa et al. ..... 399/66
6,029,024 A * 2/2000 Bae ..... 399/66
6,111,594 A * 8/2000 Jeong ..... 347/140
6,243,545 B1 * 6/2001 Jewell ..... 399/67
6,477,339 B1 * 11/2002 Yano et al. ..... 399/66
2004/0047641 A1 * 3/2004 Kato et al. ..... 399/45
2006/0245768 A1 * 11/2006 Takeda et al. ..... 399/16

FOREIGN PATENT DOCUMENTS

JP 05-303296 11/1993
JP 05-313517 11/1993
JP 06-161295 6/1994

* cited by examiner

*Primary Examiner* — David Porta
*Assistant Examiner* — Marcus Taningco
(74) *Attorney, Agent, or Firm* — Banner & Witcoff, Ltd.

(57) ABSTRACT

An image forming apparatus including an image carrier; a transfer member, which is provided in a face-to-face relation to the image carrier and to which a transfer bias is applied; a first sensor that measures a resistance value of a section between the image carrier and the transfer member; and transfer bias controlling means. The transfer bias controlling means controls the transfer bias, which is applied to the transfer member based on a first resistance value measured by the first sensor before a recording sheet enters a nip between the image carrier and the transfer member and also based on a second resistance value measured by the first sensor when the recording sheet has entered the nip between the image carrier and the transfer member.

2 Claims, 7 Drawing Sheets

FIG. 5

TABLE OF SHEET COEFFICIENTS

| | | WIDTH [mm] | | |
|---|---|---|---|---|
| | | 120 OR LESS | 120 TO 170 | 180 OR MORE |
| | | a1 , a2 | a1 , a2 | a1 , a2 |
| THICKNESS | THIN | 4 , 20 | 3.5 , 10 | 3 , 0 |
| | NORMAL | 3.5 , 30 | 3 , 25 | 2.5 , 20 |
| | THICK | 1.3 , 50 | 1 , 85 | 0.7 , 120 |

FIG. 6A TABLE TA OF CURRENT COMBINATION SELECTION VALUES

| | | SX | | | DX | | |
|---|---|---|---|---|---|---|---|
| | | WIDTH [mm] | | | WIDTH [mm] | | |
| | | 120 OR LESS | 120 TO 170 | 180 OR MORE | 120 OR LESS | 120 TO 170 | 180 OR MORE |
| THICKNESS | THIN | 2 | 2 | 1 | 4 | 3 | 2 |
| | NORMAL | 2 | 1 | 1 | 4 | 3 | 2 |
| | THICK | 11 | 11 | 11 | 13 | 12 | 11 |

FIG. 6B TABLE TA OF TRANSFER CURRENT TARGET VALUES

| | | TRANSFER CURRENT TARGET VALUE [μA] | | | |
|---|---|---|---|---|---|
| | | K | Y | M | C |
| CURRENT COMBINATION SELECTION VALUE | 1 | 11 | 10 | 11 | 12 |
| | 2 | 12 | 11 | 12 | 13 |
| | 3 | 13 | 12 | 13 | 15 |
| | 4 | 14 | 13 | 15 | 17 |
| | 11 | 6 | 5 | 6 | 7 |
| | 12 | 7 | 6 | 7 | 8 |
| | 13 | 8 | 7 | 8 | 9 |

IMAGE FORMING APPARATUS

CROSS REFERENCE TO RELATED APPLICATION

The present application claims priority from Japanese Patent Application No. 2008-300614, which was filed on Nov. 26, 2008, the disclosure of which is incorporated herein by reference in its entirety.

BACKGROUND

The present invention relates to the control of a transfer bias of an image forming apparatus.

In an image forming apparatus of an electrophotographic system, when a toner image is transferred to a sheet (recording sheet) from an image carrier, the sheet is nipped between the image carrier and a transfer member, and a transfer bias is applied between the image carrier and the transfer member. At this time, to obtain a satisfactory transfer image, the magnitude of the transfer bias is important. If, for instance, the transfer bias is insufficient, toner remains on the image carrier without being transferred, and the adhesiveness of the toner on the sheet becomes insufficient, possibly resulting in the scattering of the toner. Conversely, if the transfer bias becomes excessive, an electric charge occurs between the image carrier and the transfer member, which can cause image defects to occur and can also damage the image carrier.

The appropriate magnitude of the transfer bias is affected by the ambient environment, particularly the temperature and humidity. This is because the resistance of the sheet changes based on the temperature and humidity. Accordingly, in a related apparatus, a sheet is subjected to a test flow before the start of an actual copying operation, and during the test flow a volume resistance value between the adjacent transfer roller, sheet, and photoconductor is measured when the sheet is nipped between the photoconductor and the transfer roller, and the transfer bias is controlled based on the measured resistance values. Further, another related apparatus, an electrical resistance value is detected at a stage prior to the transfer, and a transfer current is selected on the basis of this electrical resistance value.

SUMMARY

However, if the sheet is subjected to a test flow before the start of an actual copying operation, the sheet used in the test flow is wasted, and the time required for the test flow is wastefully consumed. In addition, although it is possible to correct the effect due to the change of the resistance value of the transfer roller and the like, it is impossible to change the target value of an electric current flowing in correspondence with the resistance value of the sheet. Furthermore, to measure the electrical resistance value of the sheet at a stage prior to the transfer, a sensor for that measurement is required and constitutes a factor which can result in a higher cost.

Accordingly, an object of the present invention is to provide an image forming apparatus which is capable of speedily effecting image formation without providing a separate sensor to be used only for the measurement of the resistance of the recording sheet.

In accordance with a first embodiment of the invention there is provided an image forming apparatus comprising:

an image carrier;

a transfer member, which is provided in a face-to-face relation with the image carrier and to which a transfer bias is applied;

a first sensor, which measures a resistance value of a section between the image carrier and the transfer member; and a transfer bias controller which controls the transfer bias applied to the transfer member based on:

a first resistance value, which is measured by the first sensor before a recording sheet enters a nip between the image carrier and the transfer member, and a second resistance value, which is measured by the first sensor when the recording sheet enters the nip between the image carrier and the transfer member and before an image is transferred on the recording sheet by the transfer member.

BRIEF DESCRIPTION OF THE DRAWINGS

FIG. 5 is a table of sheet coefficients;

FIG. 6A is a table of current combination selection values;

FIG. 6B is a table of transfer current target values; and

DETAILED DESCRIPTION OF EXEMPLARY EMBODIMENTS

Figure 1:
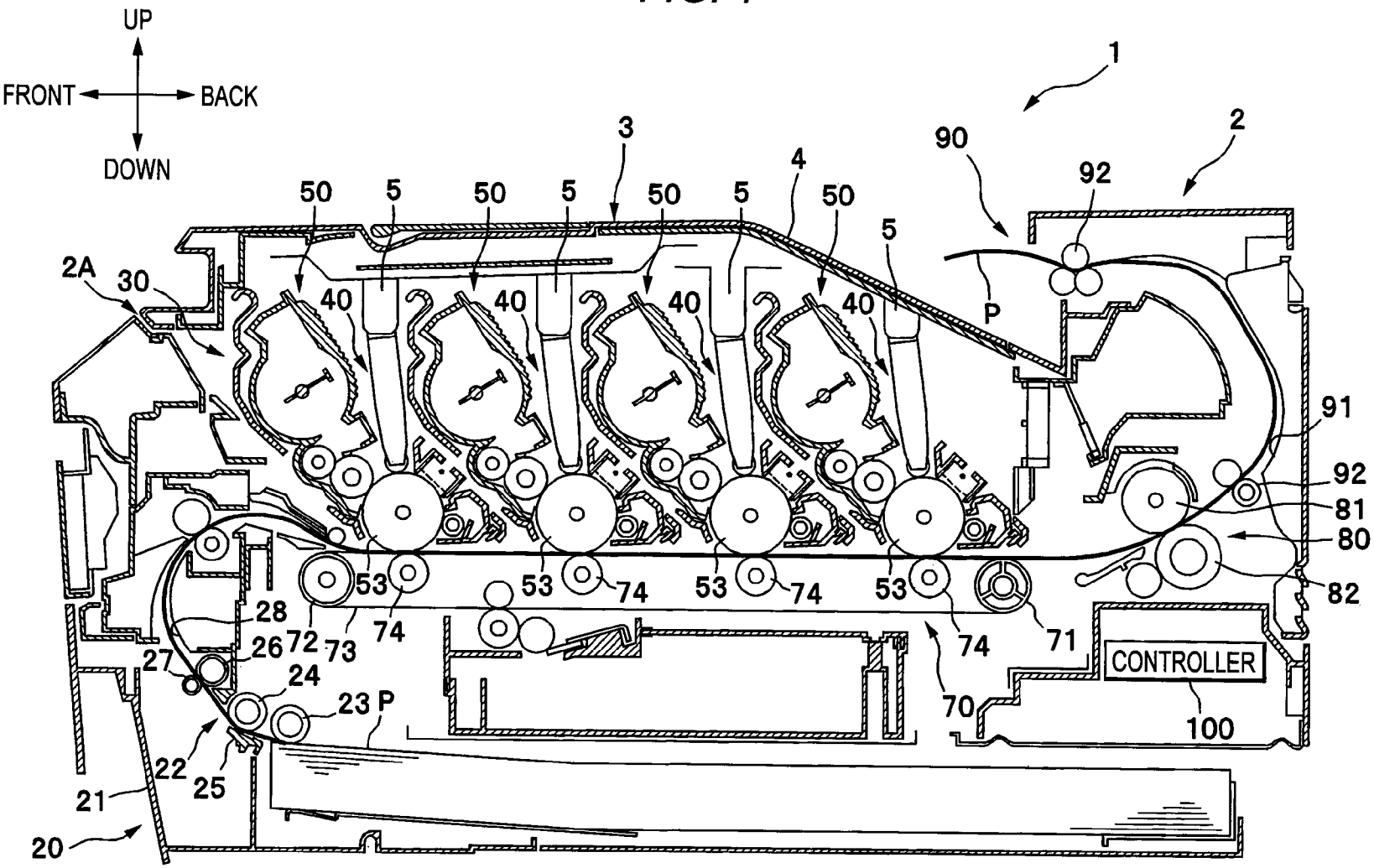
FIG. 1 is a cross-sectional view illustrating an overall configuration of a color printer as an example of an image forming apparatus.

Next, a detailed description will be given of an embodiment of the invention with appropriate reference to the accompanying drawings. It should be noted that, in the following description, after the overall configuration of the color printer is first described, the details of the exemplary embodiment of the present invention will be described.

In the following description, the directions will be described with respect to the user at the time of using the color printer. Namely, it is assumed that, in FIG. 1, when facing the plane of the drawing, the left side is the "front side," the right side is the "back side," the farther side is the "left side," and the nearer side is the "right side." Further, it is assumed that, when facing the plane of the drawing, the vertical direction is the "vertical direction."

As shown in FIG. 1, a color printer 1 has in its apparatus body 2, a sheet feeding section 20 for feeding a sheet P; an image forming section 30 for forming an image on the fed sheet P; a sheet discharging section 90 for discharging the sheet P with the image formed thereon; and a controller 100.

An opening 2A is formed in an upper portion of the apparatus body 2. This opening 2A is adapted to be opened and closed by an upper cover 3, which is rotatably supported by the apparatus body 2. The upper surface of the upper cover 3 serves as a sheet discharging tray 4 for accumulating the sheets P discharged from the apparatus body 2, and a plurality of LED mounting members 5, which holds the below-described LED units 40, are provided on the lower surface thereof.

The sheet feeding section 20 is provided in a lower portion inside the apparatus body 2, and mainly includes a sheet feeding tray 21, which is detachably installed in the apparatus body 2, as well as a sheet supplying mechanism 22 for transporting the sheet P from the sheet feeding tray 21 to the image forming section 30. The sheet supplying mechanism 22 is provided on a front side of the sheet supplying tray 21, and mainly includes a feed roller 23, a separation roller 24, and a separation pad 25.

In the sheet feeding section 20 thus configured, the sheets P in the sheet feeding tray 21 are separated one by one and are sent upward, and after paper dust is removed in the process in which the sheet P passes between a paper dust removal roller 26 and a pinch roller 27, the sheet P passes along a transport path 28 to undergo a direction change toward the backside of the image forming apparatus, and is supplied to the image forming section 30.

The image forming section 30 mainly comprises the four LED units 40, four process cartridges 50, a transfer unit 70, and a fixing unit 80.

Each LED unit 40 is swingably connected to the LED mounting member 5, and is supported by being appropriately positioned by a positioning member provided in the apparatus body 2.

The process cartridges 50 are disposed between the upper cover 3 and the sheet feeding section 20 in such a manner as to be arranged in the front-back direction, and are each comprised of a photoconductor drum 53 on which an electrostatic latent image is formed, as well as a charger, a development roller, and a toner accommodating chamber which are shown with reference numerals omitted and are heretofore known. Four photoconductor drums 53 are provided by being positioned along the transport path of the sheet P.

The transfer unit 70 is provided between the sheet feeding section 20 and the process cartridges 50, and mainly includes a drive roller 71, a driven roller 72, a transport belt 73, and transfer rollers 74.

The drive roller 71 and the driven roller 72 are disposed in parallel in such a manner as to be spaced apart in the front-back direction, and the transport belt 73 comprising an endless belt is stretched therebetween. An outer surface of the transport belt 73 is in contact with each photoconductor drum 53. Additionally, four transfer rollers 74 for nipping the transport belt 73 between the transfer roller 74 and the photoconductor drums 53 are disposed on the inner side of the transport belt 73 in correspondence with the respective photoconductor drums 53. A transfer bias is applied to each of these transfer rollers 74 by constant current control during the transfer.

The fixing unit 80 is disposed on the rear side of the process cartridges 50 and the transfer unit 70, and includes a heat roller 81 and a pressure roller 82, which is disposed in opposing relation to the heat roller 81 and is adapted to press the heat roller 81.

In the image forming section 30 thus configured, after the surface of each photoconductor drums 53 is first uniformly charged by the charger, the surface of each photoconductor drums 53 is exposed by each LED unit 40. Due to this exposure, the potential at the exposed portion drops, and an electrostatic latent image based on image data is formed on each photoconductor drum 53. Subsequently, as toner is supplied to the electrostatic latent image by the development roller, a toner image is carried on the photoconductor drum 53.

Next, as the sheet P fed onto the transport belt 73 passes between each photoconductor drum 53 and each transfer roller 74 disposed on the inner side of the transport belt 73, the toner image formed on each photoconductor drum 53 is transferred onto the sheet P. Then, as the sheet P passes between the heat roller 81 and the pressure roller 82, the toner image transferred onto the sheet P is thermally fixed.

The sheet discharging section 90 mainly includes a plurality of pairs of transport rollers 92 for transporting the sheet P and a discharged sheet side transport path 91, which is formed to extend upward from an outlet of the fixing unit 80 and then to be reversed toward the front side of the image forming apparatus. The sheet P onto which the toner image has been transferred and thermally fixed is transported along the discharged sheet side transport path 91 by the transport rollers 92, is discharged to the outside of the apparatus body 2, and is accumulated on the sheet discharging tray 4.

Next, a detailed description will be given of the control of the transfer bias.

Figure 2:
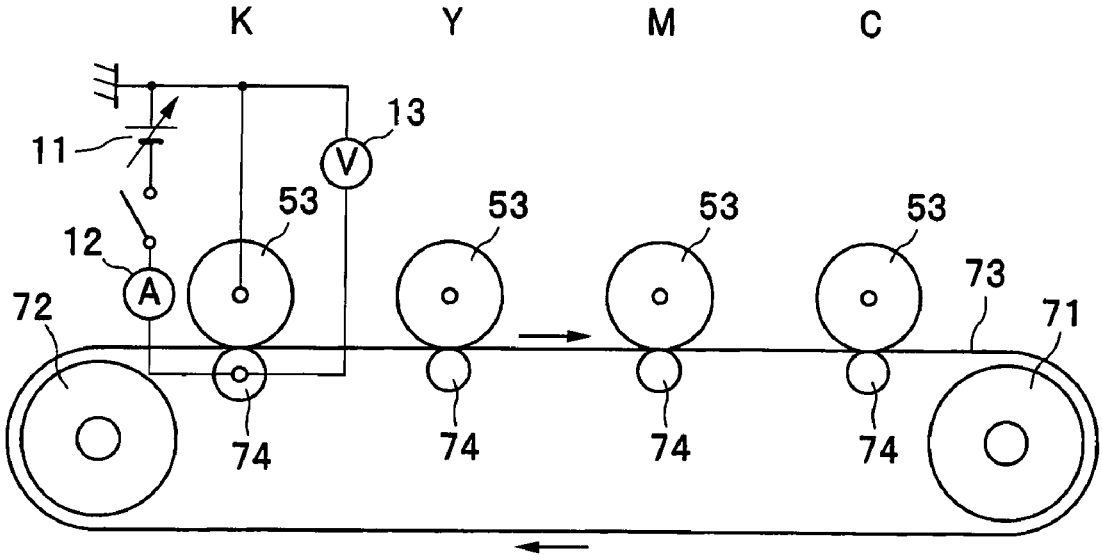
FIG. 2 is a circuit diagram for applying a voltage to a photoconductor drum and a transfer roller.
Figure 3:
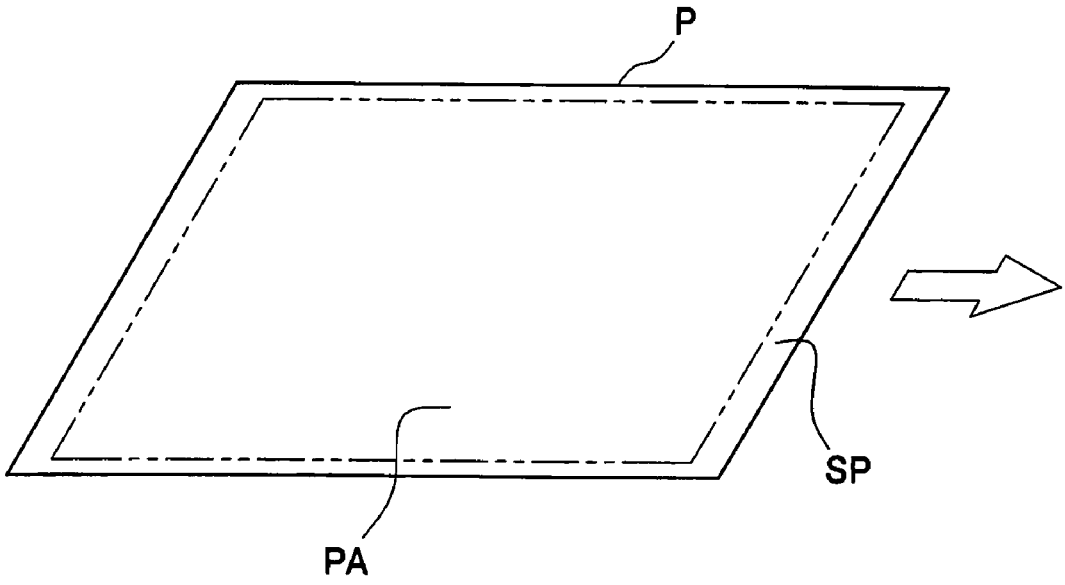
FIG. 3 is a perspective view explaining a margin area of a sheet.
Figure 4:
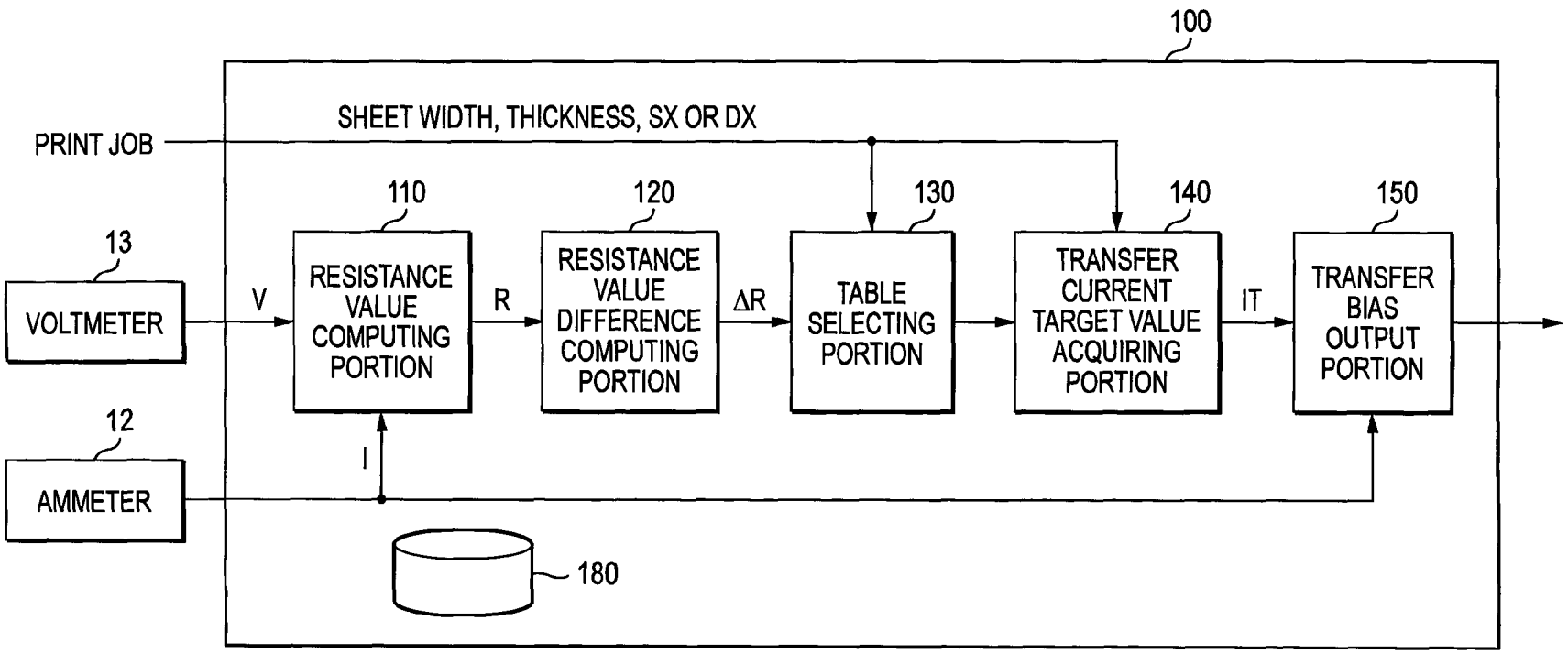
FIG. 4 is a block diagram of a controller.
Figure 7:
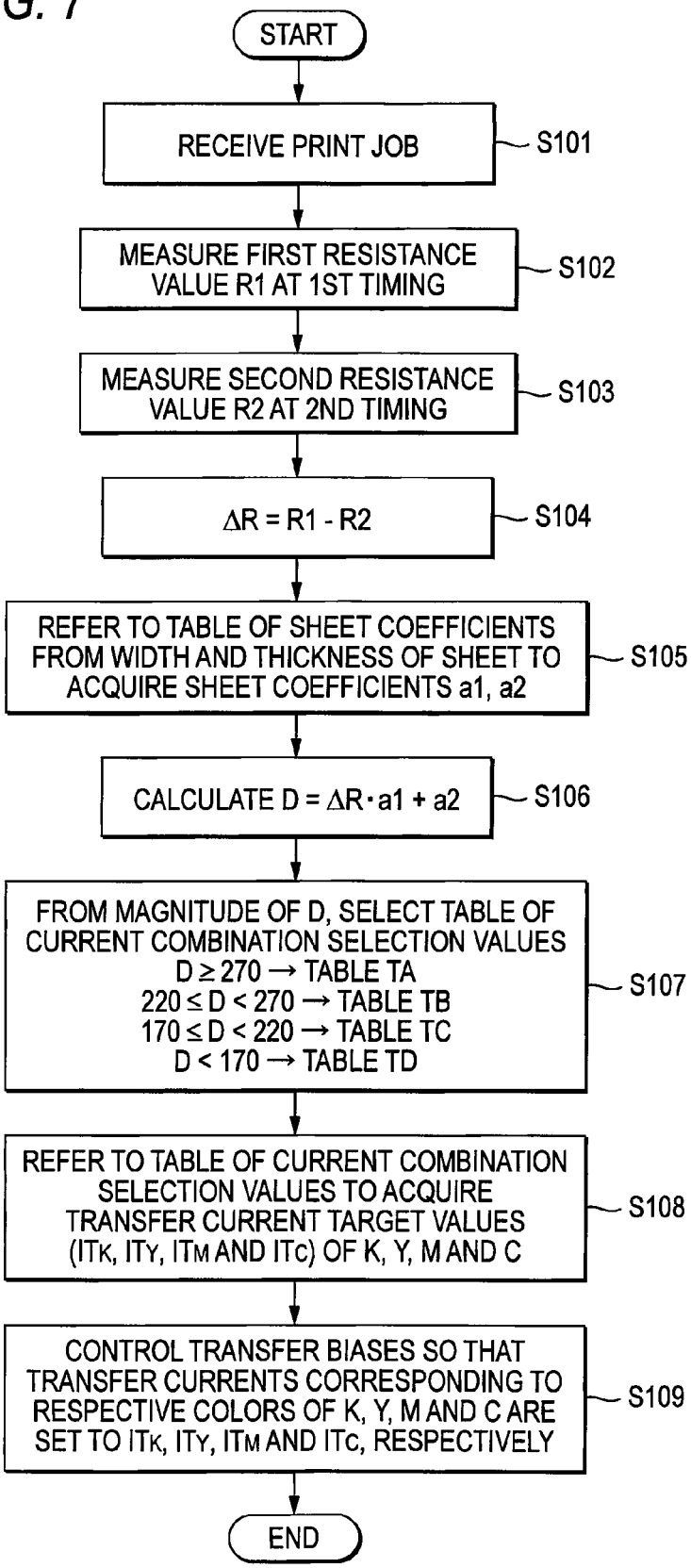
FIG. 7 is a flowchart illustrating control flow of a transfer current.

Among the drawings to which reference is made, FIG. 2 is a circuit diagram for applying a voltage to the photoconductor drum and the transfer roller; FIG. 3 is a perspective view explaining a margin area of the sheet; FIG. 4 is a block diagram of the controller; FIG. 5 is a table of sheet coefficients; FIG. 6A is a table of current combination selection values; FIG. 6B is a table of transfer current target values; and FIG. 7 is a flowchart illustrating control flow of the transfer current.

As shown in FIG. 2, the photoconductor drums 53 are disposed in the order of the respective colors of K (black), Y (yellow), M (magenta), and C (cyan) in that order from left to right in FIG. 2. Connected to each photoconductor drum 53, and each transfer roller 74 corresponding thereto, is a power supply circuit 11, which sets the transfer roller 74 side to have a negative polarity. Also provided are: an ammeter 12 for measuring the electric current flowing due to the transfer bias applied from the power supply circuit 11 to the photoconductor drum 53 and the transfer roller 74, and a voltmeter 13 for measuring the voltage of a section between the photoconductor drum 53 and the transfer roller 74. The measured values of the ammeter 12 and the voltmeter 13 are output to the controller 100. From the electric current measured by the ammeter 12 and the voltage measured by the voltmeter 13, it is possible to calculate a resistance value of the section between the photoconductor drum 53 and the transfer roller 74, so that the ammeter 12 and the voltmeter 13 are one example of a first sensor. Hereafter, the case in which a resistance value is determined on the basis of measured values of the ammeter 12 and the voltmeter 13 will simply be described as "a resistance value is measured." In addition, since the measured value of the ammeter 12 is also used for subjecting the transfer current to constant current control, the ammeter 12 is also an example of a second sensor. Namely, the ammeter 12 is a part of the first sensor and a part of the second sensor, and the part of the first sensor and the second sensor are used in common. As for the measurement of the resistance value by the first sensor, the resistance of another member may be measured insofar as the section is between the photoconductor drum 53 and the transfer roller 74.

It should be noted that although, in FIG. 2, only the circuit connected to the photoconductor drum 53 and the transfer roller 74 corresponding to the K color (black) is illustrated for convenience' sake, similar circuits are also respectively connected to the photoconductor drums 53 and the transfer rollers 74, corresponding to the respective colors of Y, M, and C.

As shown in FIG. 3, in the supplied sheet P, a margin area SP is left in a predetermined range from each side end, and a remaining central portion is set as a print area PA.

In this embodiment, as a suitable example of transfer bias control, a description will be given of a case in which transfer biases for all the transfer rollers 74, which are used at the time of image formation on the sheet P, are controlled by using a resistance value (second resistance value) measured when the margin area SP at a leading end in the transporting direction (direction of arrow in FIG. 3) of the sheet P is between the photoconductor drum 53 and the transfer roller 74 corresponding to the K color (black) located on the upstreammost side in the transporting direction of the sheet P.

This being the case, however, transfer biases for not necessarily all the transfer rollers 74 at the time of image formation on the sheet P may be controlled by using the second resistance value measured when this margin area SP is between the photoconductor drum 53 and the transfer roller 74, corresponding to the K color. For example, the transfer biases for the transfer rollers 74 corresponding to the colors other than the K color may be controlled on the basis of the second resistance value measured after the start of printing in the K color.

As shown in FIG. 4, the controller 100 has a resistance value computing portion 110, a resistance value difference computing portion 120, a table selecting portion 130, a transfer current target value acquiring portion 140, a transfer bias output portion 150, and a storage portion 180. The controller 100 has a CPU, a ROM, a RAM, and the like which are not illustrated. Information on the sheet width, sheet thickness, and single-sided printing (SX) or double-sided printing (DX), contained in a print job is inputted to the table selecting portion 130 and the transfer current target value acquiring portion 140, and a program stored in the storage portion 180 is executed by the CPU to thereby realize the functions of the above-described portions. Functions containing various tables are stored in the storage portion 180, and the results of computation performed by the controller 100 are stored, as required, in the storage portion 180.

A current value I and a voltage value V are input to the resistance value computing portion 110 from the ammeter 12 and the voltmeter 13, respectively, and a resistance value R is calculated from these values. The calculated resistance value R is output to the resistance value difference computing portion 120. The resistance value computing portion 110 acquires the current value I and the voltage value V at predetermined timings and calculates the resistance value R. Specifically, upon receipt of a print job, at two timings, i.e., before the sheet P enters a nip between the photoconductor drum 53 and the transfer roller 74, disposed on the upstreammost side and when the margin area SP at the leading end of the sheet P has entered the nip between the photoconductor drum 53 and the transfer roller 74 disposed on the upstreammost side, the current value I and the voltage value V are acquired to calculate the resistance value R. The resistance value based on the value measured before the sheet P enters the nip between the photoconductor drum 53 and the transfer roller 74 disposed on the upstreammost side, will be referred to as a first resistance value R1, and the resistance value based on the value measured when the margin area SP at the leading end of the sheet P has entered the nip between the photoconductor drum 53 and the transfer roller 74 disposed on the upstreammost side will be referred to as a second resistance value R2.

The resistance value difference computing portion 120 computes a difference $\Delta R = R1 - R2$ between the first resistance value R1 and the second resistance value R2. The calculated ΔR is outputted to the table selecting portion 130.

The table selecting portion 130 is a portion to which the value of ΔR as well as the sheet width, sheet thickness, and information on single-sided printing (SX) or double-sided printing (DX), contained in the print job, are input, and which selects from a table for acquiring a transfer current target value IT. Specifically, by referring to a table of sheet coefficients, such as the one shown in FIG. 5, sheet coefficients a1 and a2 for calculating a value D are acquired from the values of the sheet width and thickness.

Then, the value $D = \Delta R \cdot a1 + a2$ is calculated, and tables are selected on the basis of the magnitude of D. Tables referred to herein include tables of current combination selection values and tables of transfer current target values, as will be described later. Information of the selected tables is output to the transfer current target value acquiring portion 140.

The transfer current target value acquiring portion 140 is a portion to which the sheet width, sheet thickness, and information on single-sided printing (SX) or double-sided printing (DX) contained in the print job are input, and which determines the transfer current target value IT. Specifically, by referring to a table of current combination selection values such as the one shown in FIG. 6A, a current combination selection value is determined from the information on SX or DX and the width and thickness of the sheet P. Further, by referring to a table of transfer current target values such as the one shown in FIG. 6B, the transfer current target value IT is acquired from a current combination selection value. The acquired transfer current target value IT is output to the transfer bias output portion 150.

The transfer bias output portion 150 is a known means for applying a voltage to the transfer roller 74 so that the current value I measured by the ammeter 12 approaches the transfer current target value IT. For example, when the current value I has become greater than the transfer current target value IT by a predetermined value or more, the absolute value of the voltage is made small. On the other hand, when the current value I has become smaller than the transfer current target value IT by a predetermined value or more, the absolute value of the voltage is made large. In this current control, it is possible to employ so-called PWM control in which the voltage applied to the transfer roller 74 is controlled by the pulse width.

A description will be given of an example of the flow of transfer bias control based on the above-described configuration. As shown in FIG. 7, when the color printer 1 receives a print job (S101), the width and thickness of the sheet P and information on SX or DX are outputted to the table selecting portion 130 and the transfer current target value acquiring portion 140. Then, a first resistance value R1 is measured at a first timing before the sheet P enters the nip between the photoconductor drum 53 and the transfer roller 74 disposed on the upstreammost side (S102). A second resistance value R2 is measured at a second timing when the margin area SP at the leading end of the sheet P has entered the nip between the photoconductor drum 53 and the transfer roller 74 disposed on the upstreammost side (S103).

Then, the resistance value difference computing portion 120 calculates $\Delta R = R1 - R2$ (S104). Then, the table selecting portion 130 refers to the table of sheet coefficients in FIG. 5 to acquire the sheet coefficients a1 and a2 from the width and thickness of the sheet P (S105). Further, the table selecting portion 130 calculates $D = \Delta R \cdot a1 + a2$ by using the sheet coefficients a1 and a2 (S106). Then, a table of current combination selection values is selected on the basis of the magnitude of D (S107). For example, if D is not less than 270, a table TA is selected; if D is less than 270 but not less than 220, a table TB is selected; if D is less than 220 but not less than 170, a table TC is selected; and if D is less than 170, a table TD is selected. Here, a description will be given of a case in which the table TA has been selected.

The transfer current target value acquiring portion 140 refers to the table TA of current combination selection values in FIG. 6A to select a current combination selection value from the information on SX or DX and the width and thickness of the sheet P. For example, in the case of single-sided printing (SX) and if the width of the sheet P is 100 mm and the thickness is "thin," 2 is selected as the current combination selection value.

Next, the transfer current target value acquiring portion 140 refers to the table TA of transfer current target values in Table 6B to acquire transfer current target values $IT_K$, $IT_Y$, $IT_M$, and $IT_C$ corresponding to the respective colors of K, Y, M, and C from the current combination selection value (S108). For example, if the current combination selection value is 2, the transfer current target values are acquired such that $IT_K$ is 12 μA, $IT_Y$ is 11 μA, $IT_M$ is 12 μA and $IT_C$ is 13 μA.

Then, the transfer bias output portion 150 controls the transfer biases so that the transfer currents corresponding to the respective colors of K, Y, M, and C measured by the voltmeter 12 are set to the transfer current target values $IT_K$, $IT_Y$, $IT_M$, and $IT_C$ (S109).

Thus, each transfer current target value IT is selected on the basis of the difference ΔR between the first resistance value R1 and the second resistance value R2, and constant current control of the transfer bias is effected so that the transfer current approaches the transfer current target value. The difference ΔR between the first resistance value R1 and the second resistance value R2 technically means that the resistance of the sheet P is included in it, and an appropriate transfer bias can be applied by reflecting in the transfer current, the resistance of the sheet P which changes in correspondence with the environment including the humidity, the temperature, and the like. In addition, in this embodiment, since the sheet P is not subjected to test flow for measuring the electrical resistance value of the sheet P, the sheet P is not wasted, and the time for that measurement is also not wasted. Additionally, since both the first resistance value R1 and the second resistance value R2 are measured by the first sensor, it is unnecessary to provide a separate sensor, making it possible to suppress an increase in cost.

Furthermore, in this embodiment, transfer biases for all the transfer rollers 74, which are used at the time of image formation on the sheet P are controlled on the basis of the second resistance value R2 measured when the margin area SP at the leading end of the sheet P is between the photoconductor drum 53 and the transfer roller 74 located on the upstream-most side. Therefore, it is possible to form a satisfactory image by speedily reflecting the state of the sheet P on the transfer bias.

Although a description has been given above of the embodiment of the invention, the invention can be carried out by being appropriately modified without being limited to the above-described embodiment. For example, although in the above-described embodiment the transfer current target value IT is acquired on the basis of the first resistance value R1 and the second resistance value R2, and the transfer bias is subjected to constant current control, the target value of the transfer bias may be acquired as a function of the current, and the voltage applied to the transfer roller 74 may be controlled so as to assume the target value of this transfer bias.

In addition, although the form has been illustrated in which the first sensor for measuring the resistance value and the second sensor for measuring the current value are partially used in common, the first sensor and the second sensor may be formed completely separately.

Although in the above-described embodiment the difference ΔR between the first resistance value R1 and the second resistance value R2 is determined by R1−R2, before calculating this difference, at least one of R1 and R2 may be subjected to predetermined computational processing such as multiplying R1 and/or R2 by coefficient(s). Accordingly, it is possible to determine an appropriate transfer bias in correspondence with the characteristics of the apparatus used, depending on the setting of the coefficient(s).

Although in the above-described embodiment the sheet width, sheet thickness, and information on single-sided printing (SX) or double-sided printing (DX) are inputted to the controller 100, other information, e.g., information on the type of sheet such as whether the sheet is an OHP sheet, an inkjet printer sheet, or the like, may be inputted thereto, and the transfer bias may be controlled on the basis of this information.

Although in the above-described embodiment a description has been given of the case in which transfer biases for all the colors at the time of image formation on the sheet P are controlled by using the second resistance value R2 measured at the margin area SP in the vicinity of the leading end of the sheet P, it is possible to use a value measured at an area which is not a margin.

Although in the above-described embodiment only a color printer has been illustrated as the image forming apparatus, the invention is similarly applicable to a monochromatic printer as well. In addition, the invention is applicable not only to a printer but also to a copying machine and a multi-function machine.

Although in the above-described embodiment the photoconductor drum 53 is illustrated as an example of an image carrier, it is also possible to adopt an intermediate transfer medium such as an intermediate transfer belt.

What is claimed is:

1. An image forming apparatus comprising:

an image carrier;

a transfer member, which is provided in a face-to-face relation with the image carrier and to which a transfer bias is applied;

a first sensor, which measures a resistance value of a section between the image carrier and the transfer member; and a transfer bias controller which controls the transfer bias applied to the transfer member based on:

a first resistance value, which is measured by the first sensor before a recording sheet enters a nip between the image carrier and the transfer member, and a second resistance value, which is measured by the first sensor when the recording sheet enters the nip between the image carrier and the transfer member and before an image is transferred on the recording sheet by the transfer member, wherein a plurality of the image carriers are juxtaposed along a transport path of the recording sheet and the transfer members are disposed so as to correspond to the image carriers, respectively, and wherein the transfer bias controller controls the transfer biases to be applied to the respective transfer members other than the transfer member disposed on an upstream-most side in a transporting direction of the recording sheet based on the first resistance value and the second resistance value measured between the image carrier and the transfer member disposed on the upstreammost.

2. An image forming apparatus comprising:

an image carrier;

a transfer member, which is provided in a face-to-face relation with the image carrier and to which a transfer bias is applied;

a first sensor, which measures a resistance value of a section between the image carrier and the transfer member; and a transfer bias controller which controls the transfer bias applied to the transfer member based on:

a first resistance value, which is measured by the first sensor before a recording sheet enters a nip between the image carrier and the transfer member, and a second resistance value, which is measured by the first sensor when the recording sheet enters the nip between the image carrier and the transfer member and before an image is transferred on the recording sheet by the transfer member, wherein an image forming area on the recording sheet is set such that a margin area is left in a predetermined range from a leading end side in a transporting direction of the recording sheet, wherein the transfer bias controller controls the transfer bias based on the first resistance value and the second resistance value measured when the margin area enters the nip between the image carrier and the transfer member, wherein a plurality of the image carriers are juxtaposed along a transport path of the recording sheet and the transfer members are disposed so as to correspond to the image carriers, respectively, and wherein the transfer bias controller controls the transfer biases to be applied to the respective transfer members other than the transfer member disposed on an upstream-most side in a transporting direction of the recording sheet based on the first resistance value and the second resistance value measured when the margin area enters the nip between the image carrier and the transfer member disposed on the upstreammost.

* * * * *